US006030429A

United States Patent [19]

Yamazaki et al.

[11] Patent Number: 6,030,429

[45] Date of Patent: Feb. 29, 2000

[54] HARD SINTERED ALLOY

[75] Inventors: Yuji Yamazaki, Yamaguchi; Ken-ichi Takagi, Chiyoda; Kazunori Nakano, Yamaguchi, all of Japan

[73] Assignee: Toyo Kohan Co., Ltd., Tokyo, Japan

[21] Appl. No.: 09/242,065

[22] PCT Filed: May 5, 1997

[86] PCT No.: PCT/JP97/02722

§ 371 Date: Feb. 8, 1999

§ 102(e) Date: Feb. 8, 1999

[87] PCT Pub. No.: WO98/05802

PCT Pub. Date: Aug. 5, 1997

[30] Foreign Application Priority Data

Aug. 6, 1996 [JP] Japan ..... 8-221825

[51] Int. Cl.[7] ..... C22C 29/14

[52] U.S. Cl. ..... 75/244; 75/246

[58] Field of Search ..... 75/244, 246

[56] References Cited

U.S. PATENT DOCUMENTS

| | | | |
|---|---|---|---|
| 5,022,919 | 6/1991 | Shinozaki et al. | 75/238 |
| 5,238,481 | 8/1993 | Takagi et al. | 75/244 |
| 5,406,825 | 4/1995 | Horie et al. | 72/358 |

FOREIGN PATENT DOCUMENTS

| | | |
|---|---|---|
| 6057499 | 12/1985 | Japan . |
| 338328 | 6/1991 | Japan . |
| 55889 | 1/1993 | Japan . |
| 5214479 | 8/1993 | Japan . |
| 5320816 | 12/1993 | Japan . |
| 7166289 | 6/1995 | Japan . |
| 768600 | 7/1995 | Japan . |

*Primary Examiner*—Ngoclan Mai
*Attorney, Agent, or Firm*—Browdy and Neimark

[57] ABSTRACT

A hard sintered alloy having not only a wear resistance, a high corrosion resistance and a heat resistance but also a sufficiently high strength and a high tenacity in a wide temperature region from normal temperature to a high temperature is provided. In a sintered alloy comprising a hard phase containing mainly 35–95% of $Mo_2$ $NiB_2$ type complex boride, and a binding phase of hard phase binding Ni group constituting the rest, 0.1–8% of Mn with respect to the whole composition is. added, whereby a hard sintered alloy having a high strength, a high tenacity and a high corrosion resistance is obtained. Furthermore, the addition of W serves to further improve the wear resistance and mechanical characteristics, the addition of Cr and/or V the corrosion resistance and mechanical characteristics, the addition of Cu the corrosion resistance, the addition of Co the oxidation resistance and high temperature characteristics, and the addition of Nb, Zr, Ti, Ta and Hf the mechanical characteristics and corrosion resistance.

24 Claims, No Drawings

HARD SINTERED ALLOY

BACKGROUND AND OBJECTIVES

The present invention relates to a sintered hard alloy with superior corrosion resistance and wear resistance and also having high strength, hardness, fracture toughness, and corrosion resistance in a wide temperature range from room temperature to high temperature, which comprises a hard phase consisting mainly of the $Mo_2NiB_2$ type complex boride and a binding phase of Ni-base metallic matrix which binds the hard phase.

The demand of wear resistant materials grows intensively year after year and materials having not only wear resistance but also corrosion resistance, heat resistance, fracture toughness, and high strength and hardness at high temperature as well as at room temperature are desired. Conventionally, WC-base cemented carbide or Ti (CN)-base cermet has been well known for wear resistance applications. However, they have shortcomings for usage because of insufficient corrosion resistance, strength, and hardness in a corrosive environment or a high temperature region. Focusing on superior characteristics of borides such as high hardness, high melting point, and electric conductivity and so on, a sintered hard alloy which makes use of metal complex borides such as $Mo_2FeB_2$ and $MO_2NiB_2$ and so on has been proposed as a substitutional candidate for conventional hard materials in recent years.

In these materials, a $Mo_2FeB_2$ type hard alloy comprising a binding phase of a Fe-base matrix (Japanese Patent Publication Sho 60-57499) has insufficient corrosion resistance. On the other hand, a $Mo_2NiB_2$ type hard alloy comprising a binding phase of a Ni-base matrix (for examples, Japanese Patent Publications Hei 3-38328, Hei 5-5889, and Hei 7-68600) which was invented for the purpose of improvement of corrosion resistance of the $Mo_2FeB_2$ type hard alloy has superior corrosion resistance and heat resistance but has insufficient strength at room temperature.

Moreover, a $Mo_2NiB_2$ type hard alloy which is disclosed in laid-open Japanese Patent Publication Hei 5-214479 has accomplished high strength while maintaining superior corrosion resistance and heat resistance by controlling the crystal structure of the boride constituting a hard phase as the tetragonal structure. However, the wear resistance of this hard alloy mainly depends on hardness, that is to say, the amount of the hard phase comprising the boride. Therefore, increasing the amount of the hard phase for the purpose of improving wear resistance leads to the tendency of decreasing strength and fracture toughness.

Consequently, materials with all superior characteristics such as high wear resistance, corrosion resistance, and heat resistance and high strength and toughness have not been obtained yet.

The objective of the present invention is to develop an alloy having the characteristics of $Mo_2NiB_2$ type hard alloy as mentioned above, especially, high hardness, strength, and fracture toughness and the challenge of the present invention is to provide a sintered hard alloy having not only wear resistance, corrosion resistance, and heat resistance but also sufficient strength and toughness in a wide temperature range from room temperature to high temperature, high strength, high toughness and high corrosion resistance.

SUMMARY OF THE INVENTION

The present invention relates to a sintered hard alloy with high strength, high toughness, and high corrosion resistance, wherein the sintered alloy comprises a hard phase containing mainly 35–95% of the $Mo_2NiB_2$ type complex boride and a binding phase of a Ni-base matrix which binds the hard phase mentioned above and also contains 0.1–8% of Mn with respect to the whole composition.

It is characterized that the said sintered hard alloy comprises 3–7.5% of B, 21.3–68.3% of Mo, 0.1–8% of Mn, and 10% or more of Ni as the rest.

It is also characterized that a part of content of Mo comprised in the said sintered hard alloy is substituted by 0.1–30% of W Moreover, it is characterized that a part of content of Mo comprised in the said sintered hard alloy is substituted by 0.2–10% of Nb.

It is also characterized that a part of content of Mo comprised in the said sintered hard alloy is substituted by 0.3–40% of W and Nb.

It is also characterized that a part of content of Ni comprised in the said sintered hard alloy is substituted by 0.1–5% of Cu.

It is also characterized that a part of content of Ni comprised in the said sintered hard alloy is substituted by 0.2–10% of Co.

It is also characterized that a part of content of Ni comprised in the said sintered hard alloy is substituted by 0.3–15% of Cu and Co.

It is also characterized that a part of content of Mo comprised in the said sintered hard alloy is substituted by 0.1–30% of W and a part of content of Ni is substituted by 0.1–5% of Cu.

It is also characterized that a part of content of Mo comprised in the said sintered hard alloy is substituted by 0.1–30% of W and a part of content of Ni is substituted by 0.2–10% of Co.

It is also characterized that a part of content of Mo comprised in the said sintered hard alloy is substituted by 0.1–30% of W and a part of content of Ni is substituted by 0.3–15% of Cu and Co.

It is also characterized that a part of content of Mo comprised in the said sintered hard alloy is substituted by 0.2–10% of Nb and a part of content of Ni is substituted by 0.1–5% of Cu.

It is also characterized that a part of content of Mo comprised in the said sintered hard alloy is substituted by 0.2–10% of Nb and a part of content of Ni is substituted by 0.2–10% of Co.

It is also characterized that a part of content of Mo comprised in the said sintered hard alloy is substituted by 0.2–10% of Nb and a part of content of Ni is substituted by 0.3–15% of Cu and Co.

It is also characterized that a part of content of Mo comprised in the said sintered hard alloy is substituted by 0.3–40% of W and Nb and a part of content of Ni is substituted by 0.1–5% of Cu.

It is also characterized that a part of content of Mo comprised in the said sintered hard alloy is substituted by 0.3–40% of W and Nb and a part of content of Ni is substituted by 0.2–10% of Co.

Moreover, a sintered hard alloy with high strength, high toughness, and high corrosion resistance, which is characterized that a part of content of Mo comprised in the said sintered hard alloy is substituted by 0.3–40% of W and Nb and a part of content of Ni is substituted by 0.3–15% of Cu and Co, is provided.

The present invention also relates to a sintered hard alloy with high strength, high toughness, and high corrosion resistance, which is characterized that a part or whole of Nb comprised in the said sintered hard alloy is substituted by one or two or more elements selected in Zr, Ti, Ta, and Hf.

It is also characterized that a part of Ni comprised in the said sintered hard alloy is substituted by Cr.

It is also characterized that a part or whole of Cr mentioned above is substituted by V It is also characterized that a content of Cr mentioned above is 0.1–35%.

It is also characterized that a content of V mentioned above is 0.1–35%.

It is also characterized that the total content of both Cr and V mentioned above is 0.1–35%.

Moreover, it is characterized that the ratio of Ni in the binding phase of the said sintered hard alloy is 40% or more.

DETAILED DESCRIPTION OF THE INVENTION

The present invention provides a sintered hard alloy with high corrosion resistance containing Mn, wherein the sintered hard alloy comprising a hard phase containing mainly the $Mo_2NiB_2$ type complex boride and a binding phase of a Ni-base matrix which binds the hard phase, and the sintered hard alloy with high strength, high toughness, and high corrosion resistance mainly comprising two phases of the fine complex boride and the binding phase of a Ni-base matrix is obtained by limiting the contents of B and Mo within a constant range and controlling the content of Ni in the binding phase of a Ni-base matrix. The wear resistance and the mechanical properties are also improved by an addition of W in the sintered hard alloy. The corrosion resistance and the mechanical properties of the sintered hard alloy of the present invention are further improved by additions of Cr and/or V, the corrosion resistance is improved by an addition of Cu, the oxidation resistance and the high temperature characteristics are improved by an addition of Co, and the mechanical properties and the corrosion resistance are improved by additions of Nb, Zr, Ti, Ta and Hf.

The present invention will be explained in further detail by examples mentioned below. The inventors proposed the sintered hard alloy with high strength, superior corrosion resistance and heat resistance produced by additions of Cr and V, which caused the changing of crystal structure of complex boride from ordinary orthorhombic to tetragonal, to $Mo_2NiB_2$ type sintered hard alloys having superior corrosion resistance as described in laid-open Japanese patent publication Hei 5-214479. From further various studies of $Mo_2NiB_2$ type sintered hard alloys possibly maintaining high hardness and having high strength and toughness, the possibility of increment of strength and hardness is found for any complex boride with orthorhombic and tetragonal structure while maintaining corrosion resistance and heat resistance without decrement of fracture toughness by containing Mn in the hard alloy. It is considered that the microstructure is significantly changed by an addition of Mn and especially suppression of grain growth of the boride is achieved contributing to the improvement of strength and hardness. In the case of an alloy in which Mn is added, the sintering temperature range where high strength is obtained is expanded and well shaped sintered bodies with little distortion are obtained, and therefore processing toward near net shaping is possible. In other words, in the case of $Mo_2NiB_2$ type sintered hard alloy with superior corrosion resistance, containing 0.1–8% of Mn is needed in order to improve mechanical properties. Sufficient improvement of mechanical properties is not recognized in the case of less than 0.1% of Mn. On the other hand, additions of excess of 8% of Mn generate coarsening the boride and transverse rupture strength and fracture toughness decrease due to formation of an intermetallic compound between Ni and Mn. Accordingly, the content of Mn is limited to 0.1–8%.

A hard phase contributes to mainly the hardness of the present hard alloy, namely, wear resistance. The amount of the $Mo_2NiB_2$ type complex boride comprised in the hard phase is favorably 35–95% in any case of orthorhombic and tetragonal structure. In the case of less than 35% of the amount of the complex boride, the hardness of the present hard alloy is 75 or less in Rockwell A scale and the wear resistance decreases. On the other hand, in the case of excess of 95% of the amount of complex boride, the dispersivity of the boride decreases and the decrement of strength is remarkable. Accordingly, a ratio of complex boride in the present hard alloy is limited to 35–95%.

B is an essential element in order to produce the complex boride as a hard phase in the present hard alloy and 3–7.5% is contained in the hard alloy. In the case of less than 3% of B content, the amount of the complex boride decreases, and the wear resistance decreases, because the ratio of the hard phase in the structure falls short of 35%. On the other hand, in the case of excess of 7.5%, the amount of the hard phase exceeds 95% and the strength decreases. Accordingly, the content of B in the present hard alloy is limited to 3–7.5%.

Mo as in the case of B is an essential element in order to produce the complex boride as the hard phase. A part of Mo dissolves in the binding phase and it improves not only the wear resistance of the alloy but also the corrosion resistance against a reducing environment such as hydrofluoric acid. From the results of various experiments, in the case of less than 21.3% of Mo, the wear resistance and the corrosion resistance decrease and the strength also decreases because of the formation of a Ni boride and so on. On the other hand, in the case of excess of 68.3% of Mo content, the strength decreases due to the formation of a brittle intermetallic compound of the Mo—Ni system. Accordingly, the content of Mo is limited to 21.3–68.3% in order to maintain corrosion resistance, wear resistance, and strength of the alloy.

Ni as in the cases of B and Mo is an essential element in order to produce the complex boride. In the case of less than 10% of Ni, the strength remarkably decreases, because an insufficient amount of a liquid phase appears during sintering so that a dense sintered body cannot be obtained. Accordingly, the rest except for additional components mentioned above of the composition of the alloy is 10% or more of Ni. Moreover, if the total amount of the additional components except for Ni exceeds 90% and it is impossible to contain 10% of Ni, it is needless to say that the amount of each component decreases within each permissible percent range by weight and the rest maintains 10% or more of Ni. Ni is also the main element composing the binding phase. The binding phase of the sintered hard alloy of the present invention is an alloy comprising Ni, Mn which is essential to achieve the purpose of the sintered hard alloy of the present invention, and one or two or more elements of Mo, W, Cu, Co, Nb, Zr, Ti, Ta, Hf, Cr, and V, wherein the amount of Ni content is favorably 40% or more and it is desirably 50% or more. That is because of decrease in the binding force of the complex boride, the strength of the Ni binding phase, and finally the strength of the sintered hard alloy, if the Ni content in the binding phase is lower than the above values. Accordingly, the content of Ni in the binding phase of Ni-base matrix is limited to 40% or more.

W is substituted for Mo and partitions primarily in the complex boride, and it improves the wear resistance of the alloy. Furthermore, a part of W dissolves in the binding phase and improves the strength due to suppression of grain growth of the complex boride but less than 0.1%of W cannot recognize these effects. On the other hand, excess of 30% of W cannot provide further improvement of the properties compared with the proper additional amount and leads to increase in the specific gravity and the weight of products. Accordingly, the content of W is limited to 0.1–30%.

Cu dissolves mainly in the binding phase of Ni-base matrix and it shows further improvement of corrosion resistance of the hard alloy of the present invention. The effect cannot be observed in the case of less than 0.1% Cu but the mechanical property deteriorates in the case of excess of 5%. Therefore, in the case of an addition of Cu in the present hard alloy, the content is limited to 0.1–5%.

Co dissolves in both phases such as the boride of the hard alloy of the present invention and the binding phase of the Ni-base matrix and it shows improving of strength at high temperatures and oxidation resistance of the present hard alloy. The effect cannot be observed in the case of less than 0.2% of Co. On the other hand, further improvement of the properties cannot be observed in the case of excess of 10% of Co compared with the proper additional amount and the excessive addition causes increase in material cost. Therefore, the additional amount of Co is limited to 0.2–10%.

In the case of adding Nb in the hard alloy of the present invention, Nb dissolves in the complex boride and a part of Nb forms borides and so on, which brings increase in hardness. Moreover, Nb dissolves in the binding phase and suppresses coarsening of boride size during sintering, and then affects the improvement of strength as well as corrosion resistance of the alloy. The effect cannot be observed in the case of less than 0.2% of Nb. On the other hand, further improvement of the properties cannot be observed in the case of excess of 10% of Nb addition compared with the proper additional amount and the excessive addition causes increase in materials cost. The strength also decreases because of the increment of the amount of other borides and so on. Therefore, the additional amount of Nb is limited to 0.2–10%. The addition of Zr, Ti, Ta, and Hf to the hard alloy of the present invention shows the similar effect to Nb. Moreover, Zr and Ti especially affect the improvement of corrosion resistance against molten metals (zinc and aluminum and so on), Ta affects the improvement of corrosion resistance against oxidizing environments such as nitric acid and so on, and Hf affects the improvement of properties at high temperatures. However, on the whole, these elements are expensive so that the usage of them causes the rise of the cost. These elements can be added not only each of them separately but also two or more simultaneously. Accordingly, the additional amount of the elements is limited to 0.2–10% of the total of one or two or more of Nb, Zr, Ti, Ta, and Hf.

Cr and V are substituted for Ni and dissolve in the complex boride and they have the effect to stabilize the crystal structure of the complex boride as tetragonal structure. Additional Cr and V also dissolve in the binding phase of the Ni-base matrix and extensively improve corrosion resistance, wear resistance, high temperature properties, and mechanical properties of the hard alloy. In the case of less than 0.1% of the total content of either Cr or V or both of them, the effect is hardly observed. On the other hand, in the case of excess of 35%, borides such as $Cr_5B_3$ and so on are formed so that the strength decreases. Accordingly, the total amount of the content of either Cr or V or both of them is limited to 0.1–35%.

Furthermore, it is needless to say that there is no problem to contain slightly small amount of inevitable impurities (Fe, Si, Al, Mg, P, S, N, O, and C and so on) introduced during the production process of the hard alloy of the present invention or other elements (rare earth element and so on) to the extent without loss of the purpose and the effect of the sintered hard alloy of the present invention.

The sintered hard alloy of the present invention is produced by liquid phase sintering in non-oxidation atmospheres such as vacuum, reducing gases, or inert gases and so on, after the metal and/or alloy powders are mixed and comminuted in an organic solvent with a vibration ball mill and so on and then dried, granulated, and formed into shapes to obtain the purpose and the effect of the sintered hard alloy, wherein the metal and/or alloy powders comprise metal powders of three essential elements of Ni, Mo, and Mn or alloy powders composed of two or more of these three elements, and simple substance powder of B or the B containing alloy powders with one or two or more selected essential elements. In the case of adding Cr, V, W, Cu, Co, Nb, Zr, Ti, Ta, and Hf which are properly selected and added depending on the alloy in addition to three essential elements such as Ni, Mo, and Mn, it is also needless to say that they can take the same powder form as the case for three essential elements mentioned above. Although the complex boride as the hard phase of the hard alloy of the present invention is formed by a reaction of the powder of the raw materials mentioned above during sintering, it is also possible to produce the $Mo_2NiB_2$ type complex boride by a prior reaction with borides of Mo and Ni or simple substance powder of B and metal powders of Mo and Ni in a furnace and then to add metal powders of Ni and Mo as the composition of the binding phase and a proper amount of metal powder of Mn. It is also needless to say that there is no problem to produce the complex boride by partly substituting either one or two or more elements of W, Nb, Zr, Ti, Ta, or Hf for Mo in the complex boride mentioned above and partly either one or two or more elements of Co, Cr, or V for Ni and then to add the proper amount of metal powder of Mn accompanied with metal powders such as Ni and so on so that the composition is adjusted to the same as the binding phase. Although mixing and comminuting of the hard alloy of the present invention is carried out in an organic solvent using a vibration ball mill and so on, the average particle size of the powders comminuted by a vibration ball mill is preferably 0.2–5 $\mu$m in order to conduct the forming reaction of boride during sintering smoothly and sufficiently. In the case of less than 0.2 $\mu$m after comminuting, the improvement effect by size refinement is small and prolonged comminuting time is required. On the other hand, in the case of excess of 5 $\mu$m, the forming reaction of the boride cannot proceed smoothly, the grain size of the hard phase in the sintered body is larger, and the transverse rupture strength decreases. Liquid phase sintering of the present hard alloy that varies with the compositions of the alloys is carried out generally at 1423–1673 K for 5–90 minutes. In the case of less than 1423 K, densification by sintering cannot proceed sufficiently. On the other hand, in the case of excess of 1673 K, an excessive amount of liquid phase is generated and distortion of the sintered body is significant. Accordingly, the final sintering temperature is limited to 1423–1673 K Preferably it is 1448–1648 K Generally, the heating rate during sintering is 0.5–60 K/minute and in the case of slower than 0.5 K/minute, prolonged time is needed to reach the proper heating temperature. On the other hand, in the case of faster than 60 K/minute, the temperature control of a sintering furnace is significantly difficult. Accordingly, the heating rate during sintering is limited to 0.5–60 K/minute, and preferably it is 1–30 K/minute. The sintered hard alloy of the present invention can be also produced by not only a normal sintering method but also other sintering methods such as hot press sintering, hot isostatic pressing, and resistant heating sintering and so on.

EMBODIMENTS

The present invention will be explained to be more specific by showing examples and comparative ones in Tables 1–32.

The powders of borides as shown in Table 1 and pure metal powders as shown in Table 2 were used as raw materials, and these powders were mixed at the ratio of the compounds as shown in Tables 18–32 as the composition shown in Tables 3–17, and then the mixing and comminuting were carried out in acetone for 30 hours with a vibration ball mill. The powders after ball milling were dried and granulated, and then the obtained fine powders were pressed into green compacts prior to sintered at 1473–1633 K for 30 minutes. The heating rate during sintering was 10 K/minute.

Tables 1–32

Tables 33–47 show the measurement results of percent by weight of hard phase (complex boride) in the structure, transverse rupture strength, hardness, and fracture toughness by the SEPB method as the mechanical properties about test samples after sintering of the sintered hard alloy with the composition of the present invention shown in the Examples and the Comparative ones. The percentage of the hard phase in the structure is measured by an image analyzer quantitatively.

Tables 33–47

It is found that all Examples 1–84 shows superior mechanical properties, especially, high hardness and excellent transverse rupture strength and fracture toughness in comparison with Comparative examples 1–44 from Tables 33–47. Examples 1–10 are the alloys combined variously with essential four elements such as B, Mo, Mn, and Ni in order to produce the sintered hard alloy of the present invention within the claimed range in claim 2. Since all of Examples 1 and 2 are the in the lower limit of the content of B and Mo, respectively, the hardness shows slightly lower values but they are alloys having the advantage of cutting possibility, extremely high fracture toughness, and superior impact resistance. Since Examples 7 and 8 are also in the higher limit of the contents of B and Mo, respectively, they are alloys having high hardness and superior wear resistance.

Examples 11–15 are alloys having 5.5% B—50% Mo—4.5% Mn—40% Ni (%: percent by weight) as a basic composition with additions of W and Nb substituted for Mo and Cu and Co substituted for Ni separately and simultaneously within the described range in claims 3–17. W and Nb increase strength of the alloy, especially, hardness and improve wear resistance as shown in Examples 11–13 and 14–16. Cu increases fracture toughness as shown in Examples 20–22 and Co increases transverse rupture strength and improves quality and life-time of the alloy as shown in Examples 23–25. It is found that an additional effect of each element can be maintained by complex addition of the elements mentioned above from the results of Examples 17–19 or 26–28 and so on. In addition to the mechanical properties at room temperature shown in Examples, additional alloying of W, Nb, and Cu also resulted in the improvement of corrosion resistance and additional alloying of Co was resulted in the improvement of transverse rupture strength at high temperatures and oxidation resistance.

Examples 56–62 are alloys with addition of one or two or more of elements such as Ta, Ti, Zr, and Hf described in claim 18 within the claimed range. Any of the elements shows the effect of increment of hardness of the alloy. In addition to the mechanical properties, Ta showed improvement of corrosion resistance against nitric acid solution, Ti and Zr showed improvement of corrosion resistance against molten aluminum, and Hf was recognized the improvement of transverse rupture strength at high temperatures, respectively.

Examples 63–81 are alloys with additions of Cr and V described in claims 21–23. The alloys with Cr and V show significant improvement of hardness and transverse rupture strength as shown in Examples 63–66 and 75–78, because a part or whole of the complex boride changes the crystal structure from orthorhombic to tetragonal. Cr also showed improvement of corrosion resistance and oxidation resistance and V showed improvement of hardness at high temperatures.

Examples 82–84 are alloys where the ratio of Ni in the binding phase described in claim 24 is 40% as the lowest limit of the claimed range. It shows superior mechanical properties, because any brittle intermetallic compound such as Ni—Mo does not precipitate.

On the other hand, Comparative example 1 is an alloy having less than the lowest limit of the content of B described in claim 2, and the wear resistance is low because of lower hardness such as 73.2 HRA. Since the amount of the metal binding phase is large, distortion of the sintered body causes a difficulty in sintering a near net shape.

Comparative example 2 is an alloy having excess of the highest limit of the content of B described in claim 2. Although the hardness of the alloy is high, pores remain in the sintered body because of small amount of the metal binding phase and both of transverse rupture strength and fracture toughness show lower values.

Comparative examples 3 and 4 are alloys having out of the range of the content of Mo described in claim 2. In the case of a lower amount of Mo as shown in Comparative example 3, an excessive amount of boride between Ni—B precipitates and in the case of a higher amount of Mo as shown in Comparative example 4, large amount of intermetallic compound between Ni—Mo precipitates, therefore, transverse rupture strength and fracture toughness decrease.

Comparative examples 5 and 6 have compositions out of the range of the content of Mn described in claim 2. In the case of a lower amount of Mn of Comparative example 5, the improvement of hardness and transverse rupture strength is not observed and in the case of a higher amount of Mn of Comparative example 6, the mechanical properties decreases due to coarsening of complex boride and formation of an intermetallic compound between Ni—Mn.

Comparative examples 7–36 are alloys having compositions of W, Nb, Cu, and Co out of the claimed range described in claims 3–17. In the case of less than the lowest limit of the claimed additional amount of each element such as Comparative examples 7, 9, 13, and 15, the improvement effect of hardness and transverse rupture strength as expected by additions of W and Nb, the improvement of transverse rupture strength expected by an addition of Co, and the improvement of fracture toughness as expected by an addition of Cu are not observed. The improvement of the mechanical properties cannot be observed by adding two or more elements simultaneously which are less than the claimed additional amount of each element as shown in Comparative examples 11, 17, and 23. In the case of alloys having excess of the highest limit of the claimed additional amount of each element as shown in Comparative examples 8, 10, 12, and 14, Cu decreases hardness, W, Nb, and Co can not provide the improvement effect of the properties as expected by an additional amount, W increases the specific gravity of the alloy, and Nb and Co increase the cost of powders.

Comparative examples 37–42 are alloys having out of the claimed range of Cr and V described in claims 21–23. In the case of alloys less than the lowest limit of the claimed additional amount of the elements added separately and simultaneously as shown in Comparative examples 37, 39, and 41, the improvement of hardness and transverse rupture strength can not be observed. In the case of excess of the highest limit of the claimed additional amount of the elements as shown in Comparative examples 38, 40, and 42, the decrement of transverse rupture strength can be observed.

Comparative examples 43 and 44 are alloys that the ratio of Ni in the binding phase described in claim 24 is less than 40%. Both examples cause decrease in transverse rupture strength and fracture toughness, because a large amount of a brittle intermetallic compound precipitates in the structure.

As explained above, a sintered hard alloy containing the $Mo_2NiB_2$ type complex boride and a binding phase of a Ni-base matrix of the present invention is an alloy maintaining superior corrosion resistance and properties at high temperatures and showing high hardness and extremely high transverse rupture strength and fracture toughness because of containing Mn. It can be applied for wide uses as high strength wear resistant materials such as cutting tools, cutter, forging dies, hot and warm forming tools, roll materials, pump parts such as mechanical seals and so on.

TABLE 1

The compositions of boride powders

| Powder name | Cemical composition of compound powder (percent by weight) | | | | | | | |
|---|---|---|---|---|---|---|---|---|
| | B | Fe | Al | Si | C | $N_2$ | $O_2$ | Other element |
| NiB | 16.1 | 0.6 | 0.03 | 0.16 | 0.06 | — | — | Ni (rest) |
| MoB | 9.7 | 0.04 | — | — | 0.1 | 0.18 | 0.23 | Mo (rest) |
| CrB | 17.4 | — | — | — | 0.2 | 0.04 | 0.18 | Cr (rest) |
| WB | 5.7 | — | — | — | 0.01 | 0.08 | 0.08 | W (rest) |
| $VB_2$ | 29.6 | — | — | — | 0.03 | 0.1 | 0.22 | V (rest) |
| $NbB_2$ | 18.7 | 0.02 | — | — | 0.03 | 0.05 | 0.1 | Nb (rest) |
| $ZrB_2$ | 19.0 | 0.02 | — | — | 0.06 | 0.03 | 0.4 | Zr (rest) |
| $TiB_2$ | 30.5 | 0.1 | — | — | 0.14 | 0.2 | 0.3 | Ti (rest) |
| $TaB_2$ | 10.3 | 0.1 | — | — | 0.05 | 0.05 | 0.1 | Ta (rest) |
| $HfB_2$ | 10.8 | 0.01 | — | — | 0.09 | 0.08 | 0.25 | Hf (rest) |

TABLE 2

Purity of pure metal powders (percent by weight)

| Metal powder | Ni | Mo | Cr | W | Mn | Cu | Co | V |
|---|---|---|---|---|---|---|---|---|
| Purity | 99.75 | 99.9 | 99.8 | 99.9 | 99.7 | 99.9 | 99.87 | 99.7 |

TABLE 3

Chemical compositions of samples of Examples (1)

| Example | Chemical composition (percent by weight) | | | | Corresponding claim No. |
|---|---|---|---|---|---|
| | B | Mo | Mn | Ni | |
| 1 | 3.0 | 21.3 | 0.1 | rest | 2 |
| 2 | 3.0 | 21.3 | 8.0 | rest | 2 |
| 3 | 3.0 | 45.3 | 0.1 | rest | 2 |
| 4 | 3.0 | 45.3 | 8.0 | rest | 2 |
| 5 | 7.5 | 53.3 | 0.1 | rest | 2 |
| 6 | 7.5 | 53.3 | 8.0 | rest | 2 |
| 7 | 7.5 | 68.3 | 0.1 | rest | 2 |
| 8 | 7.5 | 68.3 | 8.0 | rest | 2 |
| 9 | 4.5 | 58.9 | 4.5 | rest | 2 |
| 10 | 6.0 | 66.6 | 1.5 | rest | 2 |

TABLE 4

Chemical compositions of samples of Examples (2)

| Example | Chemical composition (percent by weight) | | | | | | Corresponding claim No. |
|---|---|---|---|---|---|---|---|
| | B | Mo | Mn | W | Nb | Ni | |
| 11 | 5.5 | 49.9 | 4.5 | 0.1 | — | rest | 3 |
| 12 | 5.5 | 35.0 | 4.5 | 15.0 | — | rest | 3 |
| 13 | 5.5 | 20.0 | 4.5 | 30.0 | — | rest | 3 |
| 14 | 5.5 | 49.8 | 4.5 | — | 0.2 | rest | 4 |
| 15 | 5.5 | 45.0 | 4.5 | — | 5.0 | rest | 4 |
| 16 | 5.5 | 40.0 | 4.5 | — | 10.0 | rest | 4 |
| 17 | 5.5 | 49.7 | 4.5 | 0.1 | 0.2 | rest | 5 |
| 18 | 5.5 | 30.0 | 4.5 | 15.0 | 5.0 | rest | 5 |
| 19 | 5.5 | 10.0 | 4.5 | 30.0 | 10.0 | rest | 5 |

TABLE 5

Chemical compositions of samples of Examples (3)

| Example | Chemical composition (percent by weight) | | | | | | Corresponding claim No. |
|---|---|---|---|---|---|---|---|
| | B | Mo | Mn | Cu | Co | Ni | |
| 20 | 5.5 | 50.0 | 4.5 | 0.1 | — | rest | 6 |
| 21 | 5.5 | 50.0 | 4.5 | 2.5 | — | rest | 6 |
| 22 | 5.5 | 50.0 | 4.5 | 5.0 | — | rest | 6 |
| 23 | 5.5 | 50.0 | 4.5 | — | 0.2 | rest | 7 |
| 24 | 5.5 | 50.0 | 4.5 | — | 5.0 | rest | 7 |
| 25 | 5.5 | 50.0 | 4.5 | — | 10.0 | rest | 7 |
| 26 | 5.5 | 50.0 | 4.5 | 0.1 | 0.2 | rest | 8 |
| 27 | 5.5 | 50.0 | 4.5 | 2.5 | 5.0 | rest | 8 |
| 28 | 5.5 | 50.0 | 4.5 | 5.0 | 10.0 | rest | 8 |

TABLE 6

Chemical compositions of samples of Examples (4)

| Example | Chemical composition (percent by weight) | | | | | | | Corresponding claim No. |
|---|---|---|---|---|---|---|---|---|
| | B | Mo | Mn | W | Cu | Co | Ni | |
| 29 | 5.5 | 49.9 | 4.5 | 0.1 | 0.1 | — | rest | 9 |
| 30 | 5.5 | 35.0 | 4.5 | 15.0 | 2.5 | — | rest | 9 |
| 31 | 5.5 | 20.0 | 4.5 | 30.0 | 5.0 | — | rest | 9 |
| 32 | 5.5 | 49.9 | 4.5 | 0.1 | — | 0.2 | rest | 10 |
| 33 | 5.5 | 35.0 | 4.5 | 15.0 | — | 5.0 | rest | 10 |

TABLE 6-continued

Chemical compositions of samples of Examples (4)

| Example | Chemical composition (percent by weight) B | Mo | Mn | W | Cu | Co | Ni | Corresponding claim No. |
|---|---|---|---|---|---|---|---|---|
| 34 | 5.5 | 20.0 | 4.5 | 30.0 | — | 10.0 | rest | 10 |
| 35 | 5.5 | 49.9 | 4.5 | 0.1 | 0.1 | 0.2 | rest | 11 |
| 36 | 5.5 | 35.0 | 4.5 | 15.0 | 2.5 | 5.0 | rest | 11 |
| 37 | 5.5 | 20.0 | 4.5 | 30.0 | 5.0 | 10.0 | rest | 11 |

TABLE 7

Chemical compositions of samples of Examples (5)

| Example | Chemical composition (percent by weight) B | Mo | Mn | Nb | Cu | Co | Ni | Corresponding claim No. |
|---|---|---|---|---|---|---|---|---|
| 38 | 5.5 | 49.8 | 4.5 | 0.2 | 0.1 | — | rest | 12 |
| 39 | 5.5 | 45.0 | 4.5 | 5.0 | 2.5 | — | rest | 12 |
| 40 | 5.5 | 40.0 | 4.5 | 10.0 | 5.0 | — | rest | 12 |
| 41 | 5.5 | 49.8 | 4.5 | 0.2 | — | 0.2 | rest | 13 |
| 42 | 5.5 | 45.0 | 4.5 | 5.0 | — | 5.0 | rest | 13 |
| 43 | 5.5 | 40.0 | 4.5 | 10.0 | — | 10.0 | rest | 13 |
| 44 | 5.5 | 49.8 | 4.5 | 0.2 | 0.1 | 0.2 | rest | 14 |
| 45 | 5.5 | 45.0 | 4.5 | 5.0 | 2.5 | 5.0 | rest | 14 |
| 46 | 5.5 | 40.0 | 4.5 | 10.0 | 5.0 | 10.0 | rest | 14 |

TABLE 8

Chemical compositions of samples of Examples (6)

| Example | Chemical composition (percent by weight) B | Mo | Mn | W | Nb | Cu | Co | Ni | Corresponding Claim No. |
|---|---|---|---|---|---|---|---|---|---|
| 47 | 5.5 | 49.7 | 4.5 | 0.1 | 0.2 | 0.1 | — | rest | 15 |
| 48 | 5.5 | 30.0 | 4.5 | 15.0 | 5.0 | 2.5 | — | rest | 15 |
| 49 | 5.5 | 10.0 | 4.5 | 30.0 | 10.0 | 5.0 | — | rest | 15 |
| 50 | 5.5 | 49.7 | 4.5 | 0.1 | 0.2 | — | 0.2 | rest | 16 |
| 51 | 5.5 | 30.0 | 4.5 | 15.0 | 5.0 | — | 5.0 | rest | 16 |
| 52 | 5.5 | 10.0 | 4.5 | 30.0 | 10.0 | — | 10.0 | rest | 16 |
| 53 | 5.5 | 49.7 | 4.5 | 0.1 | 0.2 | 0.1 | 0.2 | rest | 17 |
| 54 | 5.5 | 30.0 | 4.5 | 15.0 | 5.0 | 2.5 | 5.0 | rest | 17 |
| 55 | 5.5 | 10.0 | 4.5 | 30.0 | 10.0 | 5.0 | 10.0 | rest | 17 |

TABLE 9

Chemical Compositions of samples of Examples (7)

| Example | Chemical composition (percent by weight) B | Mo | Mn | W | Nb | Cu | Co | Others | Ni | Corresponding claim No. |
|---|---|---|---|---|---|---|---|---|---|---|
| 56 | 5.3 | 55.1 | 5.5 | 2.5 | — | — | — | Ta:0.2 | rest | 18 |
| 57 | 3.8 | 40.5 | 0.6 | 4.0 | — | — | — | Ta:9.0 | rest | 18 |
| 58 | 6.0 | 58.6 | 2.0 | — | — | — | — | Ti:4.0 | rest | 18 |
| 59 | 6.0 | 61.3 | 2.0 | 1.5 | — | — | — | Zr:2.0 | rest | 18 |
| 60 | 3.3 | 33.7 | 0.3 | 10.0 | — | — | 9.5 | Hf:2.5 | rest | 18 |
| 61 | 4.8 | 40.5 | 7.5 | — | — | 1.0 | — | Ta:4.0 | rest | 18 |
| 62 | 5.3 | 49.4 | 2.8 | 5.5 | 3.0 | — | — | Ta:6.0 Ti:1.0 | rest | 18 |

TABLE 10

Chemical compositions of samples of Examples (8)

| Example | Chemical composition (percent by weight) B | Mo | Mn | W | Nb | Cr | V | Others | Ni | Corresponding claim No. |
|---|---|---|---|---|---|---|---|---|---|---|
| 63 | 5.8 | 61.8 | 3.0 | — | — | 0.1 | — | — | rest | 21 |
| 64 | 5.8 | 59.2 | 0.8 | 1.0 | — | 5.0 | — | — | rest | 21 |
| 65 | 3.5 | 41.9 | 0.2 | — | — | 35.0 | — | — | rest | 21 |

TABLE 10-continued

Chemical compositions of samples of Examples (8)

| Example | Chemical composition (percent by weight) B | Mo | Mn | W | Nb | Cr | V | Others | Ni | Corresponding claim No. |
|---|---|---|---|---|---|---|---|---|---|---|
| 66 | 4.0 | 41.8 | 6.5 | 5.0 | — | 20.0 | — | — | rest | 21 |
| 67 | 4.0 | 43.5 | 4.5 | 5.0 | — | 20.0 | — | Cu:3.0 | rest | 21 |
| 68 | 5.3 | 55.1 | 5.5 | 2.5 | — | 12.5 | — | Ta:0.2 | rest | 21 |
| 69 | 3.8 | 40.5 | 0.6 | 4.0 | — | 15.0 | — | Ta:9.0 | rest | 21 |
| 70 | 6.0 | 58.6 | 2.0 | — | — | 5.0 | — | Ti:4.0 | rest | 21 |
| 71 | 6.0 | 61.3 | 2.0 | 1.5 | — | 8.0 | — | Zr:2.0 | rest | 21 |
| 72 | 3.3 | 33.7 | 0.3 | 10.0 | — | 17.5 | — | Co:9.5<br>Hf:2.5 | rest | 21 |

TABLE 11

Chemical compositions of samples of Examples (9)

| Example | Chemical composition (percent by weight) B | Mo | Mn | W | Nb | Cr | V | Others | Ni | Corresponding claim No. |
|---|---|---|---|---|---|---|---|---|---|---|
| 73 | 4.8 | 40.5 | 7.5 | — | — | 7.5 | — | Cu:1.0<br>Ta:4.0 | rest | 21 |
| 74 | 5.3 | 49.4 | 2.8 | 5.5 | 3.0 | 12.5 | — | Ta:6.0<br>Ti:1.0 | rest | 21 |
| 75 | 5.8 | 61.8 | 3.0 | — | — | — | 0.1 | — | rest | 22 |
| 76 | 6.2 | 56.7 | 6.5 | 1.5 | — | — | 7.5 | — | rest | 22 |
| 77 | 3.5 | 41.9 | 0.2 | — | — | — | 35.0 | — | rest | 22 |
| 78 | 5.3 | 54.1 | 3.0 | — | — | 2.5 | 10.0 | — | rest | 23 |
| 79 | 4.3 | 44.8 | 3.5 | 2.0 | — | 2.0 | 10.0 | Co:0.2 | rest | 23 |
| 80 | 5.3 | 54.1 | 1.5 | — | 0.2 | 3.0 | 9.0 | — | rest | 23 |
| 81 | 7.3 | 63.5 | 3.7 | 3.0 | — | 2.5 | 10.0 | — | rest | 23 |

TABLE 12

Chemical compositions of samples of Examples (10)

| Example | Chemical composition (percent by weight) B | Mo | Mn | W | Nb | Cr | V | Others | Ni | Corresponding claim No. |
|---|---|---|---|---|---|---|---|---|---|---|
| 82 | 3.2 | 45.4 | 4.6 | — | — | 27.5 | — | — | rest<br>40.0 | 24 |
| 83 | 4.8 | 51.1 | 3.0 | — | — | 20.0 | — | Ta:8.0<br>Co:8.0 | rest<br>40.0 | 24 |
| 84 | 4.2 | 44.7 | 1.8 | — | — | 30.0 | — | Co:9.0<br>Cu:4.0 | rest<br>40.0 | 24 |

A numeric value in Ni column of Examples 82–84 indicates amount of Ni (percent by weight) in the binding phase.

TABLE 13

Chemical compositions of samples of Comparative examples (1)

| Comparative example | Chemical composition (percent by weight) B | Mo | Mn | W | Nb | Ni | Corresponding claim No. |
|---|---|---|---|---|---|---|---|
| 1 | 2.5 | 37.7 | 4.5 | — | — | rest | 2 |
| 2 | 7.8 | 58.9 | 4.5 | — | — | rest | 2 |
| 3 | 6.0 | 20.0 | 1.5 | — | — | rest | 2 |
| 4 | 6.0 | 69.5 | 1.5 | — | — | rest | 2 |

TABLE 13-continued

Chemical compositions of samples of Comparative examples (1)

| Comparative example | Chemical composition (percent by weight) B | Mo | Mn | W | Nb | Ni | Corresponding claim No. |
|---|---|---|---|---|---|---|---|
| 5 | 6.0 | 58.6 | 0.05 | — | — | rest | 2 |
| 6 | 6.0 | 58.6 | 10.0 | — | — | rest | 2 |
| 7 | 5.5 | 50.0 | 4.5 | 0 | — | rest | 3 |
| 8 | 5.5 | 15.0 | 4.5 | 35.0 | — | rest | 3 |

TABLE 13-continued

Chemical compositions of samples of Comparative examples (1)

| Comparative example | Chemical composition (percent by weight) B | Mo | Mn | W | Nb | Ni | Corresponding claim No. |
|---|---|---|---|---|---|---|---|
| 9 | 5.5 | 49.9 | 4.5 | — | 0.1 | rest | 4 |
| 10 | 5.5 | 38.0 | 4.5 | — | 12.0 | rest | 4 |

TABLE 14

Chemical compositions of samples of Comparative examples (2)

| Comparative example | Chemical composition (percent by weight) B | Mo | Mn | W | Nb | Cu | Co | Ni | Corresponding claim No. |
|---|---|---|---|---|---|---|---|---|---|
| 11 | 5.5 | 49.9 | 4.5 | 0.05 | 0.05 | — | — | rest | 5 |
| 12 | 5.5 | 5.0 | 4.5 | 33.0 | 12.0 | — | — | rest | 5 |
| 13 | 5.5 | 50.0 | 4.5 | — | — | 0.05 | — | rest | 6 |
| 14 | 5.5 | 50.0 | 4.5 | — | — | 7.0 | — | rest | 6 |
| 15 | 5.5 | 50.0 | 4.5 | — | — | — | 0.1 | rest | 7 |
| 16 | 5.5 | 50.0 | 4.5 | — | — | — | 12.0 | rest | 7 |
| 17 | 5.5 | 50.0 | 4.5 | — | — | 0.05 | 0.1 | rest | 8 |
| 18 | 5.5 | 50.0 | 4.5 | — | — | 7.0 | 12.0 | rest | 8 |

TABLE 15

Chemical compositions of samples of Comparative examples (3)

| Comparative example | Chemical composition (percent by weight) B | Mo | Mn | W | Nb | Cu | Co | Ni | Corresponding claim No. |
|---|---|---|---|---|---|---|---|---|---|
| 19 | 5.5 | 50.0 | 4.5 | 0 | — | 0.05 | — | rest | 9 |
| 20 | 5.5 | 15.0 | 4.5 | 35.0 | — | 7.0 | — | rest | 9 |
| 21 | 5.5 | 50.0 | 4.5 | 0 | — | — | 0.1 | rest | 10 |
| 22 | 5.5 | 15.0 | 4.5 | 35.0 | — | — | 12.0 | rest | 10 |
| 23 | 5.5 | 50.0 | 4.5 | 0 | — | 0.05 | 0.1 | rest | 11 |
| 24 | 5.5 | 15.0 | 4.5 | 35.0 | — | 7.0 | 12.0 | rest | 11 |
| 25 | 5.5 | 49.9 | 4.5 | — | 0.1 | 0.05 | — | rest | 12 |
| 26 | 5.5 | 38.0 | 4.5 | — | 12.0 | 7.0 | — | rest | 12 |
| 27 | 5.5 | 49.9 | 4.5 | — | 0.1 | — | 0.1 | rest | 13 |
| 28 | 5.5 | 38.0 | 4.5 | — | 12.0 | — | 12.0 | rest | 13 |

TABLE 16

Chemical compositions of samples of Comparative examples (4)

| Comparative example | Chemical composition (percent by weight) B | Mo | Mn | W | Nb | Cu | Co | Ni | Corresponding claim No. |
|---|---|---|---|---|---|---|---|---|---|
| 29 | 5.5 | 49.9 | 4.5 | — | 0.1 | 0.05 | 0.1 | rest | 14 |
| 30 | 5.5 | 38.0 | 4.5 | — | 12.0 | 7.0 | 12.0 | rest | 14 |
| 31 | 5.5 | 49.9 | 4.5 | 0.05 | 0.05 | 0.05 | — | rest | 15 |
| 32 | 5.5 | 5.0 | 4.5 | 33.0 | 12.0 | 7.0 | — | rest | 15 |
| 33 | 5.5 | 49.9 | 4.5 | 0.05 | 0.05 | — | 0.1 | rest | 16 |
| 34 | 5.5 | 5.0 | 4.5 | 33.0 | 12.0 | — | 12.0 | rest | 16 |

TABLE 16-continued

Chemical compositions of samples of Comparative examples (4)

| Comparative example | Chemical composition (percent by weight) B | Mo | Mn | W | Nb | Cu | Co | Ni | Corresponding claim No. |
|---|---|---|---|---|---|---|---|---|---|
| 35 | 5.5 | 49.9 | 4.5 | 0.05 | 0.05 | 0.05 | 0.1 | rest | 17 |
| 36 | 5.5 | 5.0 | 4.5 | 33.0 | 12.0 | 7.0 | 12.0 | rest | 17 |

TABLE 17

Chemical compositions of samples of Comparative examples (5)

| Comparative example | Chemical composition (percent by weight) B | Mo | Mn | W | Nb | Cr | V | Ta | Ni | Corresponding claim No. |
|---|---|---|---|---|---|---|---|---|---|---|
| 37 | 5.8 | 61.8 | 3.0 | — | — | 0.05 | — | — | rest | 21 |
| 38 | 3.5 | 41.9 | 0.2 | — | — | 36.0 | — | — | rest | 21 |
| 39 | 5.8 | 61.8 | 3.0 | — | — | — | 0.05 | — | rest | 22 |
| 40 | 3.5 | 41.9 | 0.2 | — | — | — | 36.0 | — | rest | 22 |
| 41 | 5.8 | 61.8 | 3.0 | — | — | 0.03 | 0.03 | — | rest | 23 |
| 42 | 3.5 | 41.9 | 0.2 | — | — | 20.0 | 16.0 | — | rest | 23 |
| 43 | 3.9 | 51.9 | 1.5 | — | 8.0 | 20.0 | — | — | rest 37.3 | 24 |
| 44 | 6.2 | 66.0 | 2.0 | — | — | 7.0 | 8.5 | 1.5 | rest 39.5 | 24 |

The numerical values in Ni column of Comparative examples 43–44 indicate the amounts of Ni (percent by weight) in the binding phase.

TABLE 18

Mixing ratio of raw material powders of Examples (1)

| Example | Mixing ratio of raw material powders (percent by weight) MoB | Mo | Mn | NiB | Ni | Corresponding claim No. |
|---|---|---|---|---|---|---|
| 1 | 14.3 | 8.4 | 0.1 | 10.0 | rest | 2 |
| 2 | 14.3 | 8.4 | 8.0 | 10.0 | rest | 2 |
| 3 | 29.9 | 18.4 | 0.1 | — | rest | 2 |
| 4 | 29.9 | 18.4 | 8.0 | — | rest | 2 |
| 5 | 52.4 | 5.9 | 0.1 | 15.0 | rest | 2 |
| 6 | 52.4 | 5.9 | 8.0 | 15.0 | rest | 2 |

TABLE 18-continued

Mixing ratio of raw material powders of Examples (1)

| Example | Mixing ratio of raw material powders (percent by weight) MoB | Mo | Mn | NiB | Ni | Corresponding claim No. |
|---|---|---|---|---|---|---|
| 7 | 74.6 | 1.1 | 0.1 | — | rest | 2 |
| 8 | 74.6 | 1.1 | 8.0 | — | rest | 2 |
| 9 | 46.4 | 17.0 | 4.5 | — | rest | 2 |
| 10 | 61.9 | 10.7 | 1.5 | — | rest | 2 |

TABLE 19

Mixing ratio of raw material powders of Examples (2)

| Example | Mixing ratio of raw material powders (percent by weight) MoB | Mo | Mn | NiB | W | WB | $NbB_2$ | Ni | Corresponding claim No. |
|---|---|---|---|---|---|---|---|---|---|
| 11 | 40.1 | 13.7 | 4.5 | 10.0 | 0.1 | — | — | rest | 3 |
| 12 | 30.8 | 7.2 | 4.5 | 10.0 | — | 15.9 | — | rest | 3 |
| 13 | 21.5 | 0.6 | 4.5 | 10.0 | — | 31.8 | — | rest | 3 |
| 14 | 39.6 | 14.05 | 4.5 | 10.0 | — | — | 0.25 | rest | 4 |
| 15 | 27.2 | 20.45 | 4.5 | 10.0 | — | — | 6.25 | rest | 4 |
| 16 | 14.3 | 27.1 | 4.5 | 10.0 | — | — | 12.5 | rest | 4 |
| 17 | 6.91 | 43.5 | 4.5 | 29.7 | 0.1 | — | 0.25 | rest | 5 |
| 18 | 6.91 | 23.8 | 4.5 | 16.65 | — | 15.9 | 6.25 | rest | 5 |
| 19 | 6.91 | 3.8 | 4.5 | 3.3 | — | 31.8 | 12.5 | rest | 5 |

TABLE 20

Mixing ratio of raw material powders of Examples (3)

| Example | Mixing ratio of raw material powders (percent by weight) MoB | Mo | Mn | NiB | Cu | Co | Ni | Corresponding claim No. |
|---|---|---|---|---|---|---|---|---|
| 20 | 40.1 | 13.8 | 4.5 | 10.0 | 0.1 | — | rest | 6 |
| 21 | 40.1 | 13.8 | 4.5 | 10.0 | 2.5 | — | rest | 6 |
| 22 | 40.1 | 13.8 | 4.5 | 10.0 | 5.0 | — | rest | 6 |
| 23 | 40.1 | 13.8 | 4.5 | 10.0 | — | 0.2 | rest | 7 |
| 24 | 40.1 | 13.8 | 4.5 | 10.0 | — | 5.0 | rest | 7 |
| 25 | 40.1 | 13.8 | 4.5 | 10.0 | — | 10.0 | rest | 7 |
| 26 | 40.1 | 13.8 | 4.5 | 10.0 | 0.1 | 0.2 | rest | 8 |
| 27 | 40.1 | 13.8 | 4.5 | 10.0 | 2.5 | 5.0 | rest | 8 |
| 28 | 40.1 | 13.8 | 4.5 | 10.0 | 5.0 | 10.0 | rest | 8 |

TABLE 21

Mixing ratio of raw material powders of Examples (4)

| Example | Mixing ratio of raw material powders (percent by weight) MoB | Mo | Mn | NiB | W | WB | Cu | Co | Ni | Corresponding claim No. |
|---|---|---|---|---|---|---|---|---|---|---|
| 29 | 40.1 | 13.7 | 4.5 | 10.0 | 0.1 | — | 0.1 | — | rest | 9 |
| 30 | 30.8 | 7.2 | 4.5 | 10.0 | — | 15.9 | 2.5 | — | rest | 9 |
| 31 | 21.5 | 0.6 | 4.5 | 10.0 | — | 31.8 | 5.0 | — | rest | 9 |
| 32 | 40.1 | 13.7 | 4.5 | 10.0 | 0.1 | — | — | 0.2 | rest | 10 |
| 33 | 30.8 | 7.2 | 4.5 | 10.0 | — | 15.9 | — | 5.0 | rest | 10 |
| 34 | 21.5 | 0.6 | 4.5 | 10.0 | — | 31.8 | — | 10.0 | rest | 10 |
| 35 | 40.1 | 13.7 | 4.5 | 10.0 | 0.1 | — | 0.1 | 0.2 | rest | 11 |
| 36 | 30.8 | 7.2 | 4.5 | 10.0 | — | 15.9 | 2.5 | 5.0 | rest | 11 |
| 37 | 21.5 | 0.6 | 4.5 | 10.0 | — | 31.8 | 5.0 | 10.0 | rest | 11 |

TABLE 22

Mixing ratio of raw material powders of Examples (5)

| Example | Mixing ratio of raw material powders (percent by weight) MoB | Mo | Mn | NiB | $NbB_2$ | Cu | Co | Ni | Corresponding claim No. |
|---|---|---|---|---|---|---|---|---|---|
| 38 | 39.6 | 14.05 | 4.5 | 10.0 | 0.25 | 0.1 | — | rest | 12 |
| 39 | 27.2 | 20.45 | 4.5 | 10.0 | 6.25 | 2.5 | — | rest | 12 |
| 40 | 14.3 | 27.1 | 4.5 | 10.0 | 12.5 | 5.0 | — | rest | 12 |
| 41 | 39.6 | 14.05 | 4.5 | 10.0 | 0.25 | — | 0.2 | rest | 13 |
| 42 | 27.2 | 20.45 | 4.5 | 10.0 | 6.25 | — | 5.0 | rest | 13 |
| 43 | 14.3 | 27.1 | 4.5 | 10.0 | 12.5 | — | 10.0 | rest | 13 |
| 44 | 39.6 | 14.05 | 4.5 | 10.0 | 0.25 | 0.1 | 0.2 | rest | 14 |
| 45 | 27.2 | 20.45 | 4.5 | 10.0 | 6.25 | 2.5 | 5.0 | rest | 14 |
| 46 | 14.3 | 27.1: | 4.5 | 10.0 | 12.5 | 5.0 | 10.0 | rest | 14 |

TABLE 23

Mixing ratio of raw material powders of Examples (6)

| Example | Mixing ratio of raw material powders (percent by weight) MoB | Mo | Mn | NiB | WB | $NbB_2$ | Cu | Co | Ni | Corresponding claim No. |
|---|---|---|---|---|---|---|---|---|---|---|
| 47 | 6.91 | 43.5 | 4.5 | 29.7 | 0.1 | 0.25 | 0.1 | — | rest | 15 |
| 48 | 6.91 | 23.8 | 4.5 | 16.65 | 15.9 | 6.25 | 2.5 | — | rest | 15 |

TABLE 23-continued

Mixing ratio of raw material powders of Examples (6)

| Example | Mixing ratio of raw material powders (percent by weight) MoB | Mo | Mn | NiB | WB | $NbB_2$ | Cu | Co | Ni | Corresponding claim No. |
|---|---|---|---|---|---|---|---|---|---|---|
| 49 | 6.91 | 3.8 | 4.5 | 3.3 | 31.8 | 12.5 | 5.0 | — | rest | 15 |
| 50 | 6.91 | 43.5 | 4.5 | 29.7 | 0.1 | 0.25 | — | 0.2 | rest | 16 |
| 51 | 6.91 | 23.8 | 4.5 | 16.65 | 15.9 | 6.25 | — | 5.0 | rest | 16 |
| 52 | 6.91 | 3.8 | 4.5 | 3.3 | 31.8 | 12.5 | — | 10.0 | rest | 16 |
| 53 | 6.91 | 43.5 | 4.5 | 29.7 | 0.1 | 0.25 | 0.1 | 0.2 | rest | 17 |
| 54 | 6.91 | 23.8 | 4.5 | 16.65 | 15.9 | 6.25 | 2.5 | 5.0 | rest | 17 |
| 55 | 6.91 | 3.8 | 4.5 | 3.3 | 31.8 | 12.5 | 5.0 | 10.0 | rest | 17 |

TABLE 24

Mixing ratio of raw material powders of Examples (7)

| Example | Mixing ratio of raw material powders (percent by weight) MoB | Mo | Mn | W | Others | Ni | Corresponding claim No. |
|---|---|---|---|---|---|---|---|
| 56 | 54.4 | 6.4 | 5.5 | 2.5 | $TaB_2$:0.22 | rest | 18 |
| 57 | 28.5 | 14.7 | 0.6 | 4.0 | $TaB_2$:10.0 | rest | 18 |
| 58 | 43.8 | 19.1 | 2.0 | — | $TiB_2$:5.8 | rest | 18 |
| 59 | 57.0 | 9.8 | 2.0 | 1.5 | $ZrB_2$:2.5 | rest | 18 |
| 60 | 30.9 | 6.4 | 0.3 | 10.0 | Co:9.5, $HfB_2$:2.8 | rest | 18 |
| 61 | 44.8 | 0.1 | 7.5 | — | Cu:1.0, $TaB_2$:4.5 | rest | 18 |
| 62 | 35.9 | 17.0 | 2.8 | 5.5 | $NbB_2$:3.7, $TaB_2$:6.7 $TiB_2$:1.4 | rest | 18 |

TABLE 25

Mixing ratio of raw material powders of Examples (8)

| Example | Mixing ratio of raw material powders (percent by weight) MoB | Mo | Mn | W | Cr | Others | Ni | Corresponding claim No. |
|---|---|---|---|---|---|---|---|---|
| 63 | 59.8 | 7.8 | 3.0 | — | 0.1 | | rest | 21 |
| 64 | 49.5 | 14.5 | 0.8 | 1.0 | — | CrB:6.0 | rest | 21 |
| 65 | 36.1 | 9.4 | 0.2 | — | 35.0 | | rest | 21 |
| 66 | 38.1 | 8.0 | 6.5 | — | 20.0 | WB:5.3 | rest | 21 |
| 67 | 41.2 | 6.3 | 4.5 | 5.0 | 20.0 | Cu:3.0 | rest | 21 |
| 68 | 54.4 | 6.4 | 5.5 | 2.5 | 12.5 | $TaB_2$:0.22 | rest | 21 |
| 69 | 28.5 | 14.7 | 0.6 | 4.0 | 15.0 | $TaB_2$:10.0 | rest | 21 |
| 70 | 43.8 | 19.1 | 2.0 | — | 5.0 | $TiB_2$:5.8 | rest | 21 |
| 71 | 57.0 | 9.8 | 2.0 | 1.5 | 8.0 | $ZrB_2$:2.5 | rest | 21 |
| 72 | 30.9 | 6.4 | 0.3 | 10.0 | 17.5 | Co:9.5, $HfB_2$:2.8 | rest | 21 |

TABLE 26

Mixing ratio of raw material powders of Examples (9)

| Example | Mixing ratio of raw material powders (percent by weight) MoB | Mo | Mn | W | Cr | $VB_2$ | Others | Ni | Corresponding claim No. |
|---|---|---|---|---|---|---|---|---|---|
| 73 | 44.8 | 0.1 | 7.5 | — | 7.5 | — | Cu:1.0 $TaB_2$:4.5 | rest | 21 |
| 74 | 35.9 | 17.0 | 2.8 | 5.5 | 12.5 | — | $NbB_2$:3.7 $TaB_2$:6.7 $TiB_2$:1.4 | rest | 21 |
| 75 | 59.4 | 8.2 | 3.0 | — | — | 0.14 | — | rest | 22 |
| 76 | 31.4 | 28.3 | 6.5 | 1.5 | — | 10.7 | — | rest | 22 |

TABLE 26-continued

Mixing ratio of raw material powders of Examples (9)

| Example | Mixing ratio of raw material powders (percent by weight) MoB | Mo | Mn | W | Cr | $VB_2$ | Others | Ni | Corresponding claim No. |
|---|---|---|---|---|---|---|---|---|---|
| 77 | 1.4 | 40.7 | 0.2 | — | — | 11.4 | V:23.0 | rest | 22 |
| 78 | 11.3 | 43.9 | 3.0 | — | 2.5 | 14.2 | | rest | 23 |
| 79 | 1.0 | 43.9 | 3.5 | 2.0 | 2.0 | 14.2 | Co:0.2 | rest | 23 |
| 80 | 15.2 | 43.9 | 1.5 | — | 3.0 | 12.8 | $NbB_2$:0.25 | rest | 23 |
| 81 | 31.9 | 43.9 | 3.7 | 3.0 | 2.5 | 14.2 | | rest | 23 |

TABLE 27

Mixing ratio of raw material powders of Examples (10)

| Example | Mixing ratio of raw material powders (percent by weight) MoB | Mo | Mn | Cr | Co | Cu | Others | Ni | Corresponding claim No. |
|---|---|---|---|---|---|---|---|---|---|
| 82 | 33.0 | 15.7 | 4.6 | 27.5 | — | — | | rest | 24 |
| 83 | 40.0 | 15.0 | 3.0 | 20.0 | 8.0 | — | $TaB_2$:8.9 | rest | 24 |
| 84 | 43.3 | 5.6 | 1.8 | 30.0 | 9.0 | 4.0 | | rest | 24 |

TABLE 28

Mixing ratio of raw material powders of Comparative examples (1)

| Comparative example | Mixing ratio of raw material powders (percent by weight) MoB | Mo | Mn | NiB | W | $NbB_2$ | Ni | Corresponding claim No. |
|---|---|---|---|---|---|---|---|---|
| 1 | 25.3 | 14.5 | 4.5 | — | — | — | rest | 2 |
| 2 | 63.8 | 1.2 | 4.5 | 10.0 | — | — | rest | 2 |
| 3 | 12.0 | 9.3 | 1.5 | 30.0 | — | — | rest | 2 |
| 4 | 61.9 | 13.6 | 1.5 | — | — | — | rest | 2 |
| 5 | 61.9 | 2.7 | 0.05 | — | — | — | rest | 2 |
| 6 | 61.9 | 2.7 | 10.0 | — | — | — | rest | 2 |
| 7 | 6.91 | 43.8 | 4.5 | 30.0 | 0 | — | rest | 3 |
| 8 | 6.91 | 8.8 | 4.5 | 30.0 | 35.0 | — | rest | 3 |
| 9 | 6.89 | 43.9 | 4.5 | 30.0 | — | 0.13 | rest | 4 |
| 10 | 6.91 | 31.8 | 4.5 | 11.4 | — | 15.0 | rest | 4 |

TABLE 29

Mixing ratio of raw material powders of Comparative examples (2)

| Comparative example | Mixing ratio of raw material powders (percent by weight) MoB | Mo | Mn | NiB | W | $NbB_2$ | Cu | Co | Ni | Corresponding claim No. |
|---|---|---|---|---|---|---|---|---|---|---|
| 11 | 1.92 | 48.4 | 4.5 | 33.0 | 0.05 | 0.06 | — | — | rest | 5 |
| 12 | 1.93 | 3.3 | 4.5 | 14.4 | 33.0 | 15.0 | — | — | rest | 5 |
| 13 | 40.1 | 13.8 | 4.5 | 10.0 | — | — | 0.05 | — | rest | 6 |
| 14 | 40.1 | 13.8 | 4.5 | 10.0 | — | — | 7.0 | — | rest | 6 |
| 15 | 40.1 | 13.8 | 4.5 | 10.0 | — | — | — | 0.1 | rest | 7 |
| 16 | 40.1 | 13.8 | 4.5 | 10.0 | — | — | — | 12.0 | rest | 7 |
| 17 | 40.1 | 13.8 | 4.5 | 10.0 | — | — | 0.05 | 0.1 | rest | 8 |
| 18 | 40.1 | 13.8 | 4.5 | 10.0 | — | — | 7.0 | 12.0 | rest | 8 |

TABLE 30

Mixing ratio of raw material powders of Comparative examples (3)

| Comparative example | Mixing ratio of raw material powders (percent by weight) MoB | Mo | Mn | NiB | W | $NbB_2$ | Cu | Co | Ni | Corresponding claim No. |
|---|---|---|---|---|---|---|---|---|---|---|
| 19 | 6.91 | 43.8 | 4.5 | 30.0 | 0 | — | 0.05 | — | rest | 9 |
| 20 | 6.91 | 8.8 | 4.5 | 30.0 | 35.0 | — | 7.0 | — | rest | 9 |
| 21 | 6.91 | 43.8 | 4.5 | 30.0 | 0 | — | — | 0.1 | rest | 10 |
| 22 | 6.91 | 8.8 | 4.5 | 30.0 | 35.0 | — | — | 12.0 | rest | 10 |
| 23 | 6.91 | 43.8 | 4.5 | 30.0 | 0 | — | 0.05 | 0.1 | rest | 11 |
| 24 | 6.91 | 8.8 | 4.5 | 30.0 | 35.0 | — | 7.0 | 12.0 | rest | 11 |
| 25 | 6.89 | 43.9 | 4.5 | 30.0 | — | 0.13 | 0.05 | — | rest | 12 |
| 26 | 6.91 | 31.8 | 4.5 | 11.4 | — | 15.0 | 7.0 | — | rest | 12 |
| 27 | 6.89 | 43.9 | 4.5 | 30.0 | — | 0.13 | — | 0.1 | rest | 13 |
| 28 | 6.91 | 31.8 | 4.5 | 11.4 | — | 15.0 | — | 12.0 | rest | 13 |

TABLE 31

Mixing ratio of raw material powders of Comparative examples (4)

| Comparative example | Mixing ratio of raw material powders (percent by weight) MoB | Mo | Mn | NiB | W | $NbB_2$ | Cu | Co | Ni | Corresponding claim No. |
|---|---|---|---|---|---|---|---|---|---|---|
| 29 | 6.89 | 43.9 | 4.5 | 30.0 | — | 0.13 | 0.05 | 0.1 | rest | 14 |
| 30 | 6.91 | 31.8 | 4.5 | 11.4 | — | 15.0 | 7.0 | 12.0 | rest | 14 |
| 31 | 1.92 | 48.4 | 4.5 | 33.0 | 0.05 | 0.06 | 0.05 | — | rest | 15 |
| 32 | 1.93 | 3.3 | 4.5 | 14.4 | 33.0 | 15.0 | 7.0 | — | rest | 15 |
| 33 | 1.92 | 48.4 | 4.5 | 33.0 | 0.05 | 0.06 | — | 0.1 | rest | 16 |
| 34 | 1.93 | 3.3 | 4.5 | 14.4 | 33.0 | 15.0 | — | 12.0 | rest | 16 |
| 35 | 1.92 | 48.4 | 4.5 | 33.0 | 0.05 | 0.06 | 0.05 | 0.1 | rest | 17 |
| 36 | 1.93 | 3.3 | 4.5 | 14.4 | 33.0 | 15.0 | 7.0 | 12.0 | rest | 17 |

TABLE 32

Mixing ratio of raw material powders of Comparative examples (5)

| Comparative example | Mixing ratio of raw material powders (percent by weight) MoB | Mo | Mn | W | Cr | $Vb_2$ | Others | Ni | Corresponding claim No. |
|---|---|---|---|---|---|---|---|---|---|
| 37 | 59.8 | 7.8 | 3.0 | — | 0.05 | — | | rest | 21 |
| 38 | 36.1 | 9.4 | 0.2 | — | 36.0 | — | | rest | 21 |
| 39 | 59.6 | 8.0 | 3.0 | — | — | 0.07 | | rest | 22 |
| 40 | 1.4 | 40.7 | 0.2 | — | — | 11.4 | V:24.0 | rest | 22 |
| 41 | 59.7 | 7.9 | 3.0 | — | 0.03 | 0.04 | | rest | 23 |
| 42 | 1.4 | 40.7 | 0.2 | — | 20.0 | 11.4 | V:8.0 | rest | 23 |
| 43 | 21.3 | 36.5 | 1.5 | — | 20.0 | — | $NbB_2$:9.8 | rest | 24 |
| 44 | 25.3 | 43.2 | 2.0 | — | 7.0 | 12.1 | $TaB_2$:1.7 | rest | 24 |

TABLE 33

Sintering temperature, amount of hard phase, and other properties of Examples (1)

| Example | Sintering temperature K. | Amount of hard phase % | Hardness HRA | Deflective strength GPa | Fracture toughness MPa · m½ | Corresponding claim No. |
|---|---|---|---|---|---|---|
| 1 | 1473 | 35.3 | 75.6 | 1.70 | 37.9 | 2 |
| 2 | 1483 | 35.7 | 78.1 | 1.93 | 36.8 | 2 |
| 3 | 1483 | 37.7 | 77.9 | 1.92 | 35.7 | 2 |
| 4 | 1493 | 37.5 | 80.5 | 2.12 | 33.9 | 2 |

TABLE 33-continued

Sintering temperature, amount of hard phase, and other properties of Examples (1)

| Example | Sintering temperature K. | Amount of hard phase % | Hardness HRA | Deflective strength GPa | Fracture toughness MPa · m½ | Corresponding claim No. |
|---|---|---|---|---|---|---|
| 5 | 1563 | 93.0 | 85.8 | 1.65 | 20.6 | 2 |
| 6 | 1563 | 93.7 | 88.4 | 1.82 | 18.6 | 2 |
| 7 | 1583 | 94.3 | 87.2 | 1.79 | 17.6 | 2 |
| 8 | 1583 | 94.8 | 89.9 | 1.95 | 15.0 | 2 |
| 9 | 1493 | 57.2 | 81.2 | 2.39 | 34.9 | 2 |
| 10 | 1513 | 75.5 | 84.9 | 2.13 | 22.3 | 2 |

TABLE 34

Sintering temperature, amount of hard phase, and other properties of Examples (2)

| Example | Sintering temperature K. | Amount of hard phase % | Hardness HRA | Deflective strength GPa | Fracture toughness MPa · m½ | Corresponding claim No. |
|---|---|---|---|---|---|---|
| 11 | 1523 | 69.5 | 85.4 | 2.19 | 26.6 | 3 |
| 12 | 1553 | 70.0 | 86.3 | 2.25 | 25.3 | 3 |
| 13 | 1583 | 69.8 | 87.2 | 2.30 | 24.2 | 3 |
| 14 | 1523 | 69.2 | 85.6 | 2.15 | 26.4 | 4 |
| 15 | 1533 | 69.4 | 85.9 | 2.22 | 25.9 | 4 |
| 16 | 1543 | 69.4 | 86.3 | 2.27 | 25.0 | 4 |
| 17 | 1533 | 69.5 | 85.6 | 2.21 | 26.3 | 5 |
| 18 | 1553 | 69.7 | 86.4 | 2.29 | 25.5 | 5 |
| 19 | 1593 | 69.6 | 87.4 | 2.28 | 24.4 | 5 |

TABLE 35

Sintering temperature, amount of hard phase, and other properties of Examples (3)

| Example | Sintering temperature K. | Amount of hard phase % | Hardness HRA | Deflective strength GPa | Fracture toughness MPa · m½ | Corresponding claim No. |
|---|---|---|---|---|---|---|
| 20 | 1523 | 69.3 | 84.6 | 2.03 | 27.1 | 6 |
| 21 | 1523 | 69.3 | 84.5 | 2.08 | 27.0 | 6 |
| 22 | 1523 | 69.2 | 84.1 | 2.12 | 27.4 | 6 |
| 23 | 1523 | 69.4 | 84.8 | 2.16 | 26.8 | 7 |
| 24 | 1533 | 69.4 | 85.0 | 2.23 | 26.5 | 7 |
| 25 | 1533 | 69.4 | 85.2 | 2.28 | 26.3 | 7 |
| 26 | 1523 | 69.3 | 84.7 | 2.11 | 26.9 | 8 |
| 27 | 1533 | 69.5 | 84.7 | 2.17 | 26.9 | 8 |
| 28 | 1533 | 69.5 | 84.6 | 2.21 | 26.8 | 8 |

TABLE 36

Sintering temperature, amount of hard phase, and other properties of Examples (4)

| Example | Sintering temperature K. | Amount of hard phase % | Hardness HRA | Deflective strength GPa | Fracture toughness MPa · m½ | Corresponding claim No. |
|---|---|---|---|---|---|---|
| 29 | 1523 | 69.3 | 84.9 | 2.10 | 26.7 | 9 |
| 30 | 1553 | 69.5 | 85.7 | 2.18 | 26.2 | 9 |
| 31 | 1583 | 69.5 | 85.9 | 2.23 | 25.6 | 9 |
| 32 | 1523 | 69.3 | 85.3 | 2.16 | 26.6 | 10 |
| 33 | 1553 | 69.3 | 85.8 | 2.24 | 26.1 | 10 |
| 34 | 1583 | 69.6 | 86.4 | 2.29 | 25.7 | 10 |
| 35 | 1523 | 69.4 | 85.1 | 2.13 | 26.7 | 11 |
| 36 | 1553 | 69.2 | 85.7 | 2.18 | 26.2 | 11 |
| 37 | 1583 | 69.4 | 86.2 | 2.26 | 25.7 | 11 |

TABLE 37

Sintering temperature, amount of hard phase, and other properties of Examples (5)

| Example | Sintering temperature K. | Amount of hard phase % | Hardness HRA | Deflective strength GPa | Fracture toughness MPa · m½ | Corresponding claim No. |
|---|---|---|---|---|---|---|
| 38 | 1523 | 69.3 | 85.2 | 2.13 | 26.8 | 12 |
| 39 | 1533 | 69.1 | 85.7 | 2.17 | 26.5 | 12 |
| 40 | 1543 | 69.4 | 85.9 | 2.25 | 26.0 | 12 |
| 41 | 1523 | 69.2 | 85.3 | 2.14 | 26.6 | 13 |
| 42 | 1533 | 69.6 | 85.8 | 2.25 | 26.2 | 13 |
| 43 | 1543 | 69.5 | 85.9 | 2.31 | 25.7 | 13 |
| 44 | 1523 | 69.0 | 85.2 | 2.12 | 26.8 | 14 |
| 45 | 1533 | 69.4 | 85.8 | 2.27 | 26.4 | 14 |
| 46 | 1543 | 69.2 | 85.9 | 2.26 | 26.1 | 14 |

TABLE 38

Sintering temperature, amount of hard phase, and other properties of Examples (6)

| Example | Sintering temperature K. | Amount of hard phase % | Hardness HRA | Deflective strength GPa | Fracture toughness MPa · m½ | Corresponding claim No. |
|---|---|---|---|---|---|---|
| 47 | 1533 | 69.6 | 85.4 | 2.11 | 26.3 | 15 |
| 48 | 1553 | 69.4 | 86.2 | 2.19 | 25.9 | 15 |
| 49 | 1583 | 69.6 | 87.2 | 2.28 | 25.3 | 15 |
| 50 | 1533 | 69.8 | 85.5 | 2.15 | 26.2 | 16 |
| 51 | 1553 | 69.3 | 86.3 | 2.27 | 25.4 | 16 |
| 52 | 1583 | 69.7 | 87.2 | 2.33 | 24.9 | 16 |
| 53 | 1533 | 69.6 | 85.5 | 2.13 | 26.4 | 17 |
| 54 | 1553 | 69.9 | 86.3 | 2.25 | 25.7 | 17 |
| 55 | 1593 | 69.5 | 87.3 | 2.31 | 25.1 | 17 |

TABLE 39

Sintering temperature, amount of hard phase, and other properties of Examples (7)

| Example | Sintering temperature K. | Amount of hard phase % | Hardness HRA | Deflective strength GPa | Fracture toughness MPa · m½ | Corresponding claim No. |
|---|---|---|---|---|---|---|
| 56 | 1533 | 66.0 | 84.0 | 2.26 | 29.4 | 18 |
| 57 | 1493 | 48.6 | 80.3 | 2.39 | 34.9 | 18 |
| 58 | 1543 | 75.2 | 87.2 | 2.15 | 26.6 | 18 |
| 59 | 1543 | 76.1 | 87.7 | 2.09 | 26.1 | 18 |
| 60 | 1483 | 41.2 | 77.8 | 2.47 | 35.5 | 18 |
| 61 | 1503 | 56.5 | 85.9 | 2.34 | 30.3 | 18 |
| 62 | 1553 | 65.6 | 87.2 | 2.32 | 27.8 | 18 |

TABLE 40

Sintering temperature, amount of hard phase, and other properties of Examples (8)

| Example | Sintering temperature K. | Amount of hard phase % | Hardness HRA | Deflective strength GPa | Fracture toughness MPa · m½ | Corresponding claim No. |
|---|---|---|---|---|---|---|
| 63 | 1533 | 73.1 | 85.4 | 2.11 | 25.7 | 21 |
| 64 | 1523 | 73.4 | 84.9 | 2.44 | 25.6 | 21 |
| 65 | 1503 | 41.9 | 82.8 | 2.55 | 30.3 | 21 |
| 66 | 1513 | 50.5 | 84.4 | 3.13 | 29.7 | 21 |
| 67 | 1513 | 50.2 | 83.5 | 3.46 | 31.4 | 21 |
| 68 | 1553 | 66.5 | 88.2 | 3.01 | 25.4 | 21 |
| 69 | 1513 | 49.1 | 84.7 | 3.16 | 30.7 | 21 |
| 70 | 1553 | 75.6 | 88.9 | 2.47 | 23.6 | 21 |
| 71 | 1553 | 76.3 | 89.5 | 2.54 | 22.4 | 21 |
| 72 | 1503 | 42.0 | 80.6 | 3.38 | 32.0 | 21 |

TABLE 41

Sintering temperature, amount of hard phase, and other properties of Examples (9)

| Example | Sintering temperature K. | Amount of hard phase % | Hardness HRA | Deflective strength GPa | Fracture toughness MPa · m½ | Corresponding claim No. |
|---|---|---|---|---|---|---|
| 73 | 1523 | 56.8 | 87.1 | 3.04 | 26.9 | 21 |
| 74 | 1573 | 66.2 | 90.0 | 3.11 | 24.7 | 21 |
| 75 | 1533 | 73.0 | 86.2 | 2.26 | 25.4 | 22 |
| 76 | 1553 | 78.2 | 90.3 | 2.63 | 20.8 | 22 |
| 77 | 1503 | 42.0 | 84.1 | 2.70 | 30.6 | 22 |
| 78 | 1573 | 66.9 | 90.6 | 3.37 | 26.1 | 23 |
| 79 | 1553 | 54.0 | 87.8 | 3.66 | 28.3 | 23 |
| 80 | 1573 | 66.7 | 91.8 | 3.25 | 25.9 | 23 |
| 81 | 1613 | 91.6 | 93.8 | 2.48 | 16.7 | 23 |

TABLE 42

Sintering temperature, amount of hard phase, and other properties of Examples (10)

| Example | Sintering temperature K. | Amount of hard phase % | Hardness HRA | Deflective strength GPa | Fracture toughness MPa · m½ | Corresponding claim No. |
|---|---|---|---|---|---|---|
| 82 | 1503 | 41.7 | 83.4 | 3.07 | 31.6 | 24 |
| 83 | 1543 | 60.5 | 88.6 | 2.91 | 24.9 | 24 |
| 84 | 1523 | 52.3 | 86.3 | 3.00 | 28.7 | 24 |

TABLE 43

Sintering temperature, amount of hard phase, and other properties of Comparative examples (1)

| Comparative example | Sintering temperature K. | Amount of hard phase % | Hardness HRA | Deflective strength GPa | Fracture toughness MPa · m½ | Corresponding claim No. |
|---|---|---|---|---|---|---|
| 1 | 1463 | 31.2 | 73.2 | 1.84 | 39.3 | 2 |
| 2 | 1593 | 97.3 | 87.9 | 1.59 | 11.8 | 2 |
| 3 | 1513 | 72.9 | 83.2 | 1.18 | 6.9 | 2 |
| 4 | 1553 | 75.6 | 86.2 | 1.82 | 9.4 | 2 |
| 5 | 1533 | 75.5 | 84.8 | 1.72 | 18.5 | 2 |
| 6 | 1543 | 75.6 | 80.7 | 0.83 | 12.5 | 2 |
| 7 | 1523 | 69.2 | 84.7 | 1.99 | 27.3 | 3 |
| 8 | 1593 | 69.6 | 87.3 | 2.29 | 23.9 | 3 |
| 9 | 1523 | 69.3 | 84.7 | 1.97 | 27.2 | 4 |
| 10 | 1543 | 69.3 | 86.9 | 2.01 | 24.1 | 4 |

TABLE 44

Sintering temperature, amount of hard phase, and other properties of Comparative examples (2)

| Comparative example | Sintering temperature K. | Amount of hard phase % | Hardness HRA | Deflective strength GPa | Fracture toughness MPa · m½ | Corresponding claim No. |
|---|---|---|---|---|---|---|
| 11 | 1523 | 69.4 | 84.7 | 1.98 | 27.2 | 5 |
| 12 | 1593 | 69.4 | 87.2 | 1.97 | 23.6 | 5 |
| 13 | 1523 | 69.3 | 84.7 | 1.95 | 27.0 | 6 |
| 14 | 1523 | 69.4 | 82.8 | 1.99 | 27.3 | 6 |
| 15 | 1523 | 69.0 | 84.8 | 2.01 | 27.1 | 7 |
| 16 | 1543 | 69.2 | 85.3 | 2.25 | 26.0 | 7 |
| 17 | 1523 | 69.2 | 84.7 | 1.96 | 27.1 | 8 |
| 18 | 1543 | 69.4 | 83.5 | 2.17 | 26.5 | 8 |

TABLE 45

| Sintering temperature, amount of hard phase, and other properties of Comparative examples (3) | | | | | | |
|---|---|---|---|---|---|---|
| Comparative example | Sintering temperature K. | Amount of hard phase % | Hardness HRA | Deflective strength GPa | Fracture toughness MPa · m½ | Corresponding claim No. |
| 19 | 1523 | 69.3 | 84.7 | 2.00 | 26.9 | 9 |
| 20 | 1593 | 69.6 | 86.0 | 2.27 | 25.7 | 9 |
| 21 | 1523 | 69.4 | 84.8 | 2.02 | 27.2 | 10 |
| 22 | 1593 | 69.4 | 87.3 | 2.31 | 23.7 | 10 |
| 23 | 1523 | 69.3 | 84.7 | 1.95 | 27.0 | 11 |
| 24 | 1593 | 69.6 | 86.2 | 2.26 | 23.5 | 11 |
| 25 | 1523 | 69.2 | 84.7 | 1.96 | 26.9 | 12 |
| 26 | 1543 | 69.5 | 84.9 | 1.99 | 24.8 | 12 |
| 27 | 1523 | 69.3 | 84.7 | 2.00 | 27.2 | 13 |
| 28 | 1543 | 69.2 | 86.8 | 1.98 | 23.8 | 13 |

TABLE 46

| Sintering temperature, amount of hard phase, and other properties of Comparative examples (4) | | | | | | |
|---|---|---|---|---|---|---|
| Comparative example | Sintering temperature K. | Amount of hard phase % | Hardness HRA | Deflective strength GPa | Fracture toughness MPa · m½ | Corresponding claim No. |
| 29 | 1523 | 69.3 | 84.7 | 1.96 | 27.0 | 14 |
| 30 | 1543 | 69.5 | 85.0 | 1.96 | 23.9 | 14 |
| 31 | 1523 | 69.4 | 84.8 | 1.98 | 27.1 | 15 |
| 32 | 1593 | 69.7 | 86.3 | 1.96 | 23.5 | 15 |
| 33 | 1523 | 69.5 | 84.7 | 1.98 | 27.0 | 16 |
| 34 | 1593 | 69.3 | 87.3 | 2.00 | 23.6 | 16 |
| 35 | 1523 | 69.2 | 84.7 | 1.97 | 27.2 | 17 |
| 36 | 1593 | 69.3 | 86.3 | 1.95 | 23.3 | 17 |

TABLE 47

| Sintering temperature, amount of hard phase, and other properties of Comparative examples (5) | | | | | | |
|---|---|---|---|---|---|---|
| Comparative example | Sintering temperature K. | Amount of hard phase % | Hardness HRA | Deflective strength GPa | Fracture toughness MPa · m½ | Corresponding claim No. |
| 37 | 1533 | 73.0 | 85.1 | 1.90 | 26.3 | 21 |
| 38 | 1503 | 42.2 | 82.7 | 2.31 | 28.6 | 21 |
| 39 | 1533 | 73.0 | 85.1 | 1.88 | 26.5 | 22 |
| 40 | 1503 | 42.0 | 84.2 | 2.39 | 28.8 | 22 |
| 41 | 1533 | 73.2 | 85.1 | 1.89 | 26.5 | 23 |
| 42 | 1503 | 42.1 | 83.4 | 2.36 | 28.6 | 23 |
| 43 | 1553 | 48.3 | 84.2 | 2.16 | 21.8 | 24 |
| 44 | 1573 | 78.0 | 90.7 | 1.91 | 14.5 | 24 |

We claim:

1. A sintered hard alloy with high strength, high toughness, and high corrosion resistance, wherein the sintered alloy comprises a hard phase consisting mainly 35–95% by weight (hereafter, % means percent by weight) of the $Mo_2NiB_2$ complex boride and a binding phase of Ni-base matrix as the rest that binds said hard phase, and contains 0.1–8% of Mn with respect to the whole composition.

2. A sintered hard alloy with high strength, high toughness, and high corrosion resistance as specified in claim 1, wherein said sintered hard alloy is characterized by comprising 3–7.5% of B, 21.3–68.3% of Mo, 0.1–8% of Mn., and 10% or more of Ni as the rest.

3. A sintered hard alloy with high strength, high toughness and high corrosion resistance as specified in claim 1, wherein a part of content of Mo comprised in said sintered hard alloy is characteristically substituted by 0.1–30% of W.

4. A sintered hard alloy with high strength, high toughness and high corrosion resistance as specified in claim 1, wherein a part of content of Mo comprised in said sintered hard alloy is characteristically substituted by 0.2–10% of Nb.

5. A sintered hard alloy with high strength, high toughness, and high corrosion resistance as specified in claim 1, wherein a part of content of Mo comprised in said sintered hard alloy is characteristically substituted by 0.3–40% of W and Nb.

6. A sintered hard alloy with high strength, high toughness, and high corrosion resistance as specified in claim 1, wherein a part of content of Ni comprised in said sintered hard alloy is characteristically substituted by 0.1–5% of Cu.

7. A sintered hard alloy with high strength, high toughness, and high corrosion resistance as specified in claim 1, wherein a part of content of Ni comprised in said sintered hard alloy is characteristically substituted by 0.2–10% of Co.

8. A sintered hard alloy with high strength, high toughness, and high corrosion resistance as specified in claim 1, wherein a part of content of Ni comprised in said sintered hard alloy is characteristically substituted by 0.3–15% of Cu and Co.

9. A sintered hard alloy with high strength, high toughness, and high corrosion resistance as specified in claim 1, wherein a part of content of Mo comprised in said sintered hard alloy is characteristically substituted by 0.1–30% of W and a part of content of Ni characteristically substituted by 0.1–5% of Cu.

10. A sintered hard alloy with high strength, high toughness, and high corrosion resistance as specified in claim 1, wherein a part of content of Mo comprised in said sintered hard alloy is characteristically substituted by 0.1–30% of W and a part of content of Ni characteristically substituted by 0.2–10% of Co.

11. A sintered hard alloy with high strength, high toughness, and high corrosion resistance as specified in claim 1, wherein a part of content of Mo comprised in said sintered hard alloy is characteristically substituted by 0.1–30% of W and a part of content of Ni characteristically substituted by 0.3–15% of Cu and Co.

12. A sintered hard alloy with high strength, high toughness, and high corrosion resistance as specified in claim 1, wherein a part of content of Mo comprised in said sintered hard alloy is characteristically substituted by 0.2–10% of Nb and a part of content of Ni characteristically substituted by 0.1–5% of Cu.

13. A sintered hard alloy with high strength, high toughness, and high corrosion resistance as specified in claim 1, wherein a part of content of Mo comprised in said sintered hard alloy is characteristically substituted by 0.2–10% of Nb and a part of content of Ni characteristically substituted by 0.2–10% of Co.

14. A sintered hard alloy with high strength, high toughness, and high corrosion resistance as specified in claim 1, wherein a part of content of Mo comprised in said sintered hard alloy is characteristically substituted by 0.2–10% of Nb and a part of content of Ni characteristically substituted by 0.3–15% of Cu and Co.

15. A sintered hard alloy with high strength, high toughness, and high corrosion resistance as specified in claim 1, wherein a part of content of Mo comprised in said sintered hard alloy is characteristically substituted by 0.3–40% of W and Nb and a part of content of Ni characteristically substituted by 0.1–5% of Cu.

16. A sintered hard alloy with high strength, high toughness, and high corrosion resistance as specified in claim 1, wherein a part of content of Mo comprised in said sintered hard alloy is characteristically substituted by 0.3–40% of W and Nb and a part of content of Ni characteristically substituted by 0.2–10% of Co.

17. A sintered hard alloy with high strength, high toughness, and high corrosion resistance as specified in claim 1, wherein a part of content of Mo comprised in said sintered hard alloy is characteristically substituted by 0.3–40% of W and Nb and a part of content of Ni characteristically substituted by 0.3–15% of Cu and Co.

18. A sintered hard alloy with high strength, high toughness, and high corrosion resistance as specified in any of claim 4, wherein a part or whole of Nb comprised in said sintered hard alloy is characteristically substituted by one or two or more types selected in Zr, Ti, Ta, and Hf.

19. A sintered hard alloy with high strength, high toughness, and high corrosion resistance as specified in any of claim 1, wherein a part of content of Ni comprised in said sintered hard alloy is characteristically substituted by Cr.

20. A sintered hard alloy with high strength, high toughness, and high corrosion resistance as specified in claim 19, wherein a part or whole of Cr comprised in said sintered hard alloy is characteristically substituted by V.

21. A sintered hard alloy with high strength, high toughness, and high corrosion resistance as specified in claim 19, wherein a content of Cr mentioned above is characteristically 0.1–35%.

22. A sintered hard alloy with high strength, high toughness, and high corrosion resistance as specified in claim 20, wherein a content of V mentioned above is characteristically 0.1–35%.

23. A sintered hard alloy with high strength, high toughness, and high corrosion resistance as specified in claim 20, wherein the total content of both Cr and V mentioned above is characteristically 0.1–35%.

24. A sintered hard alloy with high strength, high toughness, and high corrosion resistance as specified in claim 1, wherein a ratio of Ni in the binding phase of said sintered hard alloy is characteristically 40% or more.

* * * * *